US009440431B2

(12) United States Patent
Hommi

(10) Patent No.: US 9,440,431 B2
(45) Date of Patent: Sep. 13, 2016

(54) INKJET RECORDING APPARATUS

(71) Applicant: Masashi Hommi, Kanagawa (JP)

(72) Inventor: Masashi Hommi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/931,094

(22) Filed: Nov. 3, 2015

(65) Prior Publication Data

US 2016/0136947 A1 May 19, 2016

(30) Foreign Application Priority Data

Nov. 19, 2014 (JP) ..... 2014-234533
Jun. 29, 2015 (JP) ..... 2015-130075

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC .. B41J 29/393; B41J 11/0095; B41J 2/2146; B41J 11/007; B41J 11/008; B41J 11/46; B41J 2202/21; B41J 2/125; B41J 2/16585
See application file for complete search history.

(56) References Cited

U.S. PATENT DOCUMENTS 8,840,223 B2 * 9/2014 Mizes ..... B41J 29/393 347/19
2015/0009262 A1 1/2015 Bell et al.

FOREIGN PATENT DOCUMENTS

| | | |
|---|---|---|
| JP | 2010-204255 | 9/2010 |
| JP | 2013-028135 | 2/2013 |
| JP | 2013-097313 | 5/2013 |
| JP | 2015-013476 | 1/2015 |

* cited by examiner

*Primary Examiner* — Thinh Nguyen
(74) *Attorney, Agent, or Firm* — Harness, Dickey & Pierce

(57) ABSTRACT

An inkjet recording apparatus includes a plurality of line heads disposed along a conveyance direction of a recording sheet and including a plurality of nozzles to discharge ink droplets, the plurality of nozzles disposed in a direction perpendicular to the conveyance direction of the recording sheet; a plurality of edge sensors corresponding to respective line heads, to detect a lateral edge of the recording sheet; a plurality of actuators corresponding to the respective line heads, to move to the respective line heads laterally in a sheet width direction; a head position adjustor to determine movement amounts of the respective line heads in accordance with outputs of the plurality of edge sensors; and a failure determiner to obtain outputs of the plurality of edge sensors simultaneously and identify a failure of the plurality of edge sensors based on a combination of the outputs from the plurality of edge sensors.

20 Claims, 9 Drawing Sheets

K SENSOR ABNORMAL

SHEET FEED POSITION CHANGE

FIG. 7

| | K SENSOR OUTPUT | C SENSOR OUTPUT | M SENSOR OUTPUT | Y SENSOR OUTPUT | STATUS |
|---|---|---|---|---|---|
| COMBINATION 1 | NORMAL | NORMAL | NORMAL | NORMAL | NORMAL |
| COMBINATION 2 | ABNORMAL A1 | ABNORMAL A1 | ABNORMAL A1 | ABNORMAL A1 | SHEET FEED POSITION CHANGE OR NO SHEET |
| COMBINATION 3 | ABNORMAL A2 | ABNORMAL A2 | ABNORMAL A2 | ABNORMAL A2 | SHEET FEED POSITION CHANGE |
| COMBINATION 4 | ABNORMAL A1 | NORMAL | NORMAL | NORMAL | K SENSOR ABNORMAL A1 |
| COMBINATION 5 | ABNORMAL A2 | NORMAL | NORMAL | NORMAL | K SENSOR ABNORMAL A2 |
| COMBINATION 6 | NORMAL | ABNORMAL A1 | NORMAL | NORMAL | C SENSOR ABNORMAL A1 |
| COMBINATION 7 | NORMAL | ABNORMAL A2 | NORMAL | NORMAL | C SENSOR ABNORMAL A2 |
| COMBINATION 8 | NORMAL | NORMAL | ABNORMAL A1 | NORMAL | M SENSOR ABNORMAL A1 |
| COMBINATION 9 | NORMAL | NORMAL | ABNORMAL A2 | NORMAL | M SENSOR ABNORMAL A2 |
| COMBINATION 10 | NORMAL | NORMAL | NORMAL | ABNORMAL A1 | Y SENSOR ABNORMAL A1 |
| COMBINATION 11 | NORMAL | NORMAL | NORMAL | ABNORMAL A2 | Y SENSOR ABNORMAL A2 |
| COMBINATION 12 | OTHER | | | | ALL SENSORS ABNORMAL |

| FIG.8A |
| --- |
| FIG.8B |

FIG. 9

| | K SENSOR OUTPUT | C SENSOR OUTPUT | M SENSOR OUTPUT | Y SENSOR OUTPUT | STATUS |
|---|---|---|---|---|---|
| COMBINATION 13 | NORMAL | ABNORMAL A1 | ABNORMAL A1 | ABNORMAL A1 | K SENSOR ABNORMAL |
| COMBINATION 14 | ABNORMAL A2 | ABNORMAL A1 | ABNORMAL A1 | ABNORMAL A1 | K SENSOR ABNORMAL |
| COMBINATION 15 | NORMAL | ABNORMAL A2 | ABNORMAL A2 | ABNORMAL A2 | K SENSOR ABNORMAL |
| COMBINATION 16 | ABNORMAL A1 | ABNORMAL A2 | ABNORMAL A2 | ABNORMAL A2 | K SENSOR ABNORMAL |
| COMBINATION 17 | ABNORMAL A1 | NORMAL | ABNORMAL A1 | ABNORMAL A1 | C SENSOR ABNORMAL |
| COMBINATION 18 | ABNORMAL A1 | ABNORMAL A2 | ABNORMAL A1 | ABNORMAL A1 | C SENSOR ABNORMAL |
| COMBINATION 19 | ABNORMAL A2 | NORMAL | ABNORMAL A2 | ABNORMAL A2 | C SENSOR ABNORMAL |
| COMBINATION 20 | ABNORMAL A2 | ABNORMAL A1 | ABNORMAL A2 | ABNORMAL A2 | C SENSOR ABNORMAL |
| COMBINATION 21 | ABNORMAL A1 | ABNORMAL A1 | NORMAL | ABNORMAL A1 | M SENSOR ABNORMAL |
| COMBINATION 22 | ABNORMAL A1 | ABNORMAL A1 | ABNORMAL A2 | ABNORMAL A1 | M SENSOR ABNORMAL |
| COMBINATION 23 | ABNORMAL A2 | ABNORMAL A2 | NORMAL | ABNORMAL A2 | M SENSOR ABNORMAL |
| COMBINATION 24 | ABNORMAL A2 | ABNORMAL A2 | ABNORMAL A1 | ABNORMAL A2 | M SENSOR ABNORMAL |
| COMBINATION 25 | ABNORMAL A1 | ABNORMAL A1 | ABNORMAL A1 | NORMAL | Y SENSOR ABNORMAL |
| COMBINATION 26 | ABNORMAL A1 | ABNORMAL A1 | ABNORMAL A1 | ABNORMAL A2 | Y SENSOR ABNORMAL |
| COMBINATION 27 | ABNORMAL A2 | ABNORMAL A2 | ABNORMAL A2 | NORMAL | Y SENSOR ABNORMAL |
| COMBINATION 28 | ABNORMAL A2 | ABNORMAL A2 | ABNORMAL A2 | ABNORMAL A1 | Y SENSOR ABNORMAL |
| COMBINATION 12 | OTHER | | | | ALL SENSORS ABNORMAL |

INKJET RECORDING APPARATUS

CROSS-REFERENCE TO RELATED APPLICATIONS

The present application claims priority pursuant to 35 U.S.C. §119(a) from Japanese patent application numbers 2014-234533 and 2015-130075, filed on Nov. 19, 2014 and Jun. 29, 2015, respectively, the entire disclosure of each of which is incorporated by reference herein.

BACKGROUND

1. Technical Field

The present invention relates to an inkjet recording apparatus.

2. Background Art

An inkjet recording apparatus that forms a color image includes line heads for each color, aligned in a conveyance direction of a sheet of paper (hereinafter, simply a sheet). Each line head includes a plurality of nozzles to discharge ink droplets, disposed in a direction of a width of the sheet perpendicular to the sheet conveyance direction, and discharges ink droplets of each color in a superimposed manner while conveying the sheet to form a color image on the sheet.

When the inkjet recording apparatus forms an image while conveying the long sheet wound in a roll, the sheet wobbles and gets wrinkles, so that precise superimposition of colors is degraded.

A method is disclosed, in which wobbles of an intermediate transfer belt and a sheet conveyance belt, and an index to detect a peripheral edge of the belt, are detected by a single sensor.

There is a large difference between an upper limit of output when detecting the wobble and another upper limit when detecting the index, so that the output as to the wobble and the output regarding the index can be clearly distinguished, thereby preventing erroneously taking one output for the other.

SUMMARY

In one embodiment of the disclosure, provided is an optimal inkjet recording apparatus including a plurality of line heads disposed along a conveyance direction of a recording sheet and including a plurality of nozzles to discharge ink droplets, the plurality of nozzles disposed in a direction perpendicular to the conveyance direction of the recording sheet; a plurality of edge sensors corresponding to respective line heads of the plurality of line heads, to detect a lateral edge of the recording sheet; a plurality of actuators corresponding to the respective line heads, to move to the respective line heads laterally in a sheet width direction; a head position adjustor to determine movement amounts of the respective line heads in accordance with outputs of the plurality of edge sensors; and a failure determiner to obtain outputs of the plurality of edge sensors simultaneously and identify a failure of the plurality of edge sensors based on a combination of the outputs from the plurality of edge sensors.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIGS. 6A and 6B illustrate changes of outputs from each edge sensor, in which FIG. 6A shows output changes when the edge sensor 24K is abnormal/has failed and FIG. 6B shows output changes when the conveyed position of the recording sheet is changed;

FIG. 7 is a table explaining combinations of outputs of the edge sensors and determination results;

FIG. 9 is a table explaining combinations of outputs of the edge sensors and determination results to identify the sensor abnormality/failure after it is determined that all sensors are abnormal.

DETAILED DESCRIPTION

To prevent degradation of precision in color superimposition, for example, an edge of a conveyed sheet for each color is measured by a sensor, and line heads for each color are moved laterally (in the sheet width direction) to adjust for a wobble of the edge of the sheet, so that the discharge position of the ink droplets of each color can be adjusted.

When the sensor fails, however, a correct positional adjustment amount for the line head cannot be obtained, and the precision in the color superimposition is degraded. Whether or not the sensor fails is determined when the sensor output shows an abnormal value. The abnormal value in this case implies a value that does not generally occur. However, even when the sensor has not failed, an abnormal value happens due to changes in the feed position of the sheet due to the wobble or skew.

In this case, an erroneous detection of sensor failure suspends printing operation of the inkjet recording apparatus, thereby decreasing productivity due to down time during which printing operation is suspended.

Considering such a current situation, according to at least one embodiment of the present disclosure, an inkjet recording apparatus prevents erroneous detection as to a sensor failure and reduction of productivity due to occurrence of the down time.

Hereinafter, a preferred embodiment according to the present invention will be described referring to accompanying drawings.

Figure 1:
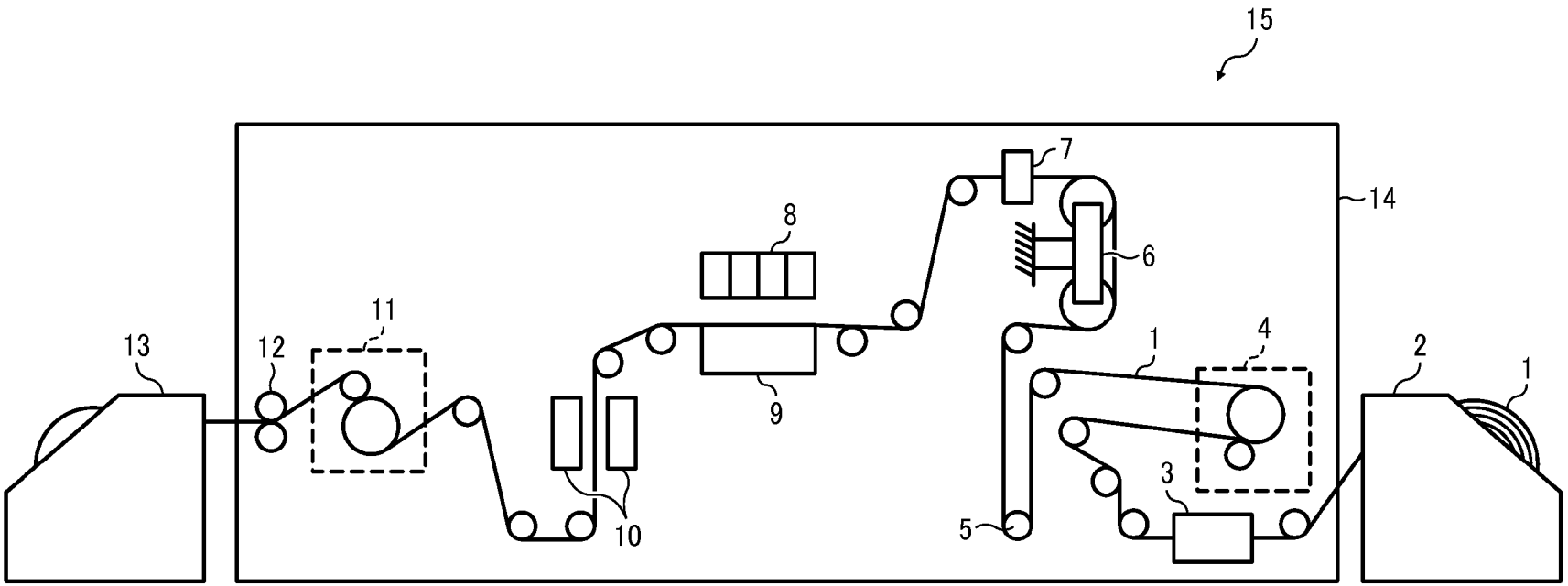
FIG. 1 is a cross-sectional view of an image forming apparatus according to an embodiment of the present invention.

FIG. 1 illustrates an inkjet recording system 15. The inkjet recording system 15 includes a sheet feeder 2 to feed a recording sheet 1 as a recording medium and an inkjet recording apparatus 14 according to the present embodiment, and a sheet collector 13.

The inkjet recording apparatus 14 is an on-demand line scan-type inkjet recording apparatus.

The sheet feeder 2 includes a recording sheet 1 wound in a roll shape and rotatably supported therein. The recording sheet 1 is fed out at a high speed from the sheet feeder 2, a predetermined color image is formed thereon, and the recording sheet 1 is sequentially rolled up by the sheet collector 13 and is collected.

The sheet feed device inside the inkjet recording apparatus 14 will be described.

The inkjet recording apparatus 14 includes a regulator 3 to regulate a position of the recording sheet 1 laterally, an infeed device 4 including a drive roller and a driven roller, and a dancer roller 5 that floats up and down with the tension on the recording sheet 1, to thereby output a positional signal.

The inkjet recording apparatus 14 further includes an Edge Position Control (EPC) 6 to control a wobble of the recording sheet 1, a wobble amount detector 7 to detect the wobble amount for use in a feedback loop, an outfeed device 11 including a drive roller and a driven roller that rotate at a constant speed to convey the recording sheet 1 at a predetermined speed, and a puller 12 including a drive roller and a driven roller that discharge the recording sheet 1 outside the apparatus.

The sheet feed device as described above performs positional detection of the dancer roller 5, controls rotation of the infeed device 4, and keeps the tension of the recording sheet 1 while being conveyed constant, that is, the present sheet feed device is a tension controlling type feeder.

Further, the inkjet recording apparatus 14 includes an inkjet recording head module 8, a platen 9 disposed opposite the inkjet recording head module 8, and a dryer 10.

The inkjet recording head module 8 includes line heads for respective colors each including a plurality of print nozzles to discharge ink droplets, disposed along an entire print area laterally of the recording sheet 1 perpendicular to the conveyance direction thereof.

Color printing is performed by each line head of respective colors of black (K), cyan (C), magenta (M), and yellow (Y), and the nozzle surface of each line head is supported above the platen 9 with a predetermined gap in between.

The inkjet recording head module 8 discharges ink droplets in synchrony with the sheet conveyance speed, so that a color image is formed on the recording sheet 1.

In the present embodiment, the dryer 10 employs a non-contact drying device disposed slightly apart from the recording sheet 1, but a contact-type drying device may also be used.

Figure 2:
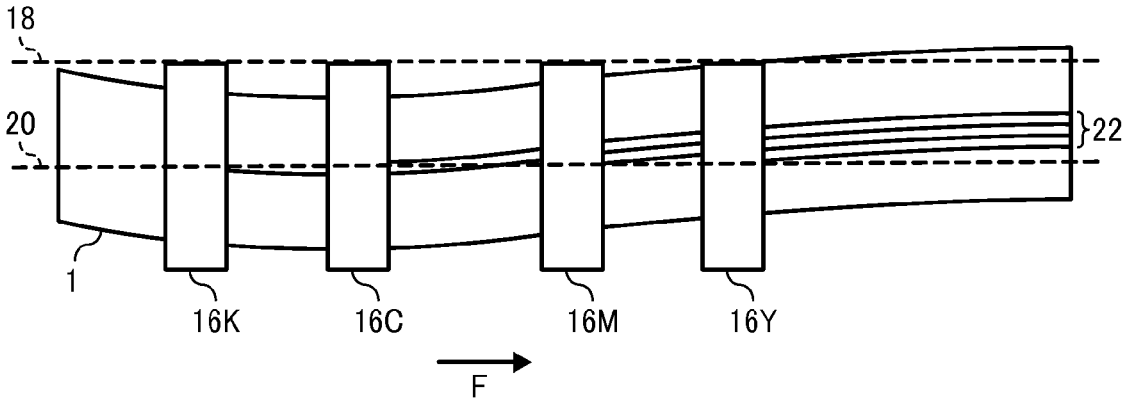
FIG. 2 is a plan view illustrating a principle of reduction of precision in color superimposition due to wobble of a recording sheet.

Referring now to FIG. 2, reduction of the precision in color superimposition due to a wobble of the recording sheet 1 will be described.

The inkjet recording head module 8 includes a line head 16K to discharge a black ink, a line head 16C to discharge a cyan ink, a line head 16M to discharge a magenta ink, and a line head 16Y to discharge a yellow ink.

Along a conveyance direction indicated by an arrow F of the recording sheet 1, the line head 16K, the line head 16C, the line head 16M, and the line head 16Y are disposed in this order from upstream to downstream.

As indicated by a broken line 18, each position of the line head 16K, the line head 16C, the line head 16M, and the line head 16Y in the sheet width direction is aligned.

When the recording sheet 1 wobbles relative to a reference line 20 in the conveyance direction, a printed position of each color of K, C, M, and Y deviates as illustrated by lines 22, and as a result, leading to a reduction of the precision in the color superimposition.

Figure 3:
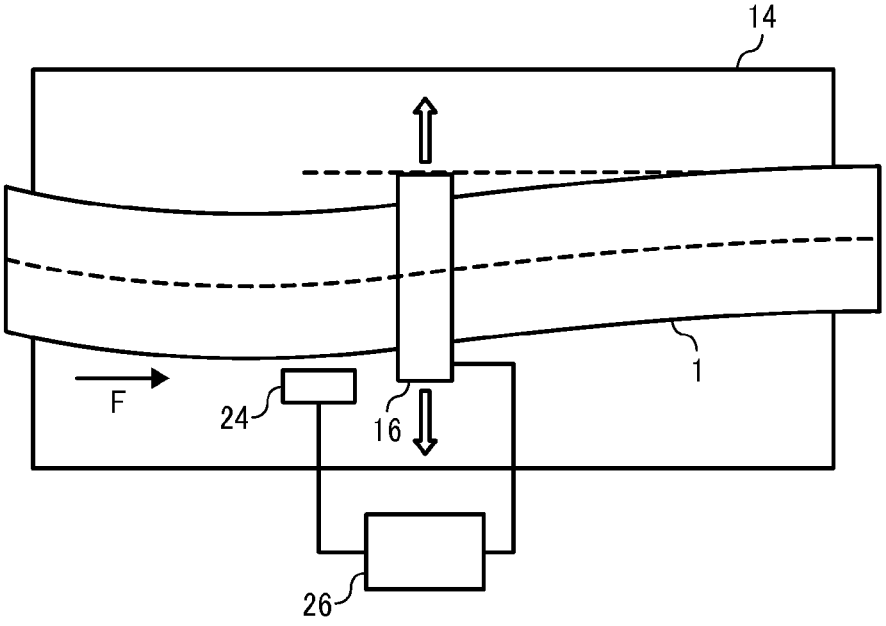
FIG. 3 is a plan view illustrating a structure to prevent reduction of the precision in the color superimposition.
Figure 4:
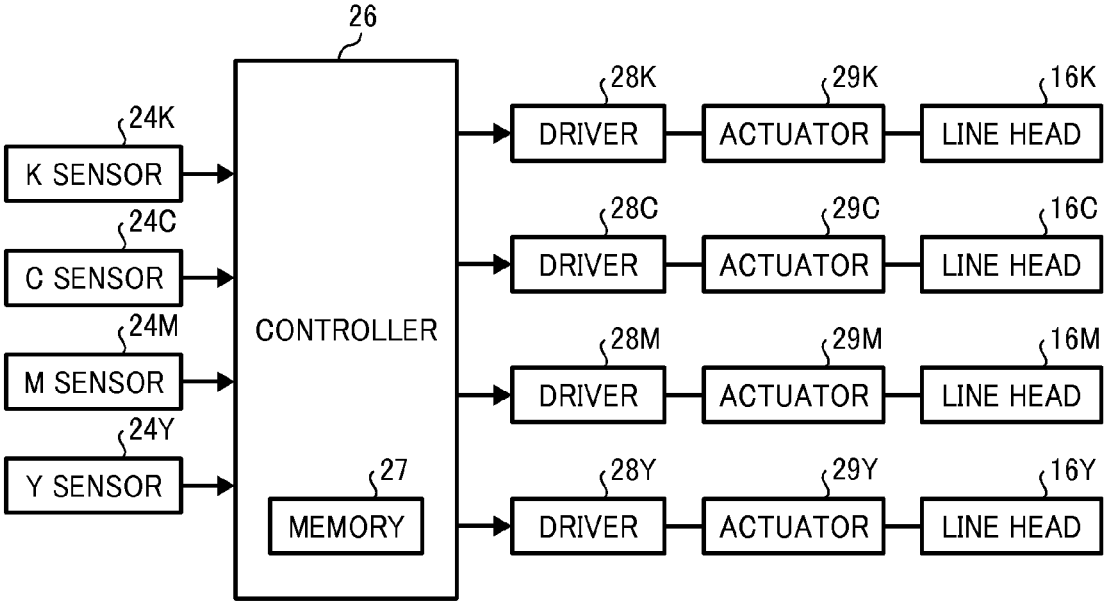
FIG. 4 is a block diagram of a controller.

Referring now to FIGS. 3 and 4, a structure to prevent reduction of the precision in the color superimposition will be described.

The structure to prevent a reduction of the precision in the color superimposition includes, as illustrated in FIGS. 3 and 4, an edge sensor 24, a driver 28, and a controller 26. The edge sensor 24 detects an end of the recording sheet 1 laterally, the driver 28 serves as a head moving means to move the line head 16 in the sheet width direction, and the controller 26 serves as a head position adjustor to determine a movement amount of the line head 16 depending on an output from the edge sensor 24.

As illustrated in FIG. 4, an actuator 29 as a head driving means, the driver 28 to drive the actuator 29, and the edge sensor 24 are disposed for each color. Specifically, an edge sensor 24 is provided to each line head.

An output of the edge sensor 24K mounted to the line head 16K defines a reference position. With the output from the edge sensor 24K as a reference position, the controller obtains a difference from outputs from the edge sensors 24C, 24M, and 24Y mounted to other line heads 16C, 16M, and 16Y, as a movement amount of the line head.

Herein, the edge sensor 24K is denoted as K sensor, the edge sensor 24C is denoted as C sensor, the edge sensor 24M is denoted as M sensor, and the edge sensor 24Y is denoted as Y sensor.

The controller 26 adjusts positions of the line heads 16C, 16M, and 16Y laterally in the sheet width direction via each driver 28C, 28M, or 28Y, based on the movement amount of each line head 16C, 16M, or 16Y.

As configured as such, even when the recording sheet 1 wobbles, a relative position of the recording sheet 1 and the line head 16 does not change, thereby preventing the precision of color superimposition from deteriorating.

Figure 5:
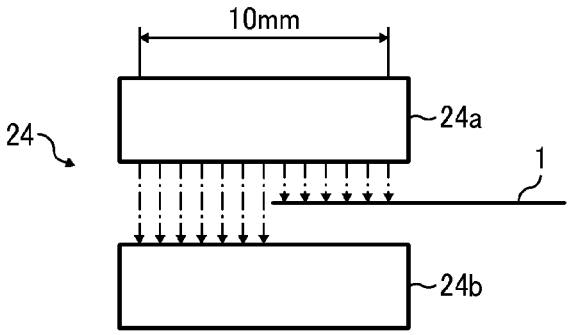
FIG. 5 is a side view illustrating a structure of an edge sensor.

As illustrated in FIG. 5, each edge sensor 24 (24K, 24C, 24M, 24Y) is a reflection-type optical sensor including a light emitting element 24*a* and a light receiving element 24*b*.

The detection range of the edge sensor 24 is 10 mm according to the present embodiment, and the edge sensor 24 outputs 5V when detecting 10 mm, and outputs 0V when detecting 0 mm according to analog conversion. Thus, when the recording sheet 1 is not present in the detection area of the edge sensor 24, the edge sensor 24 outputs 5V, and when the recording sheet 1 covers all the detection area of the edge sensor 24, the edge sensor 24 outputs 0V.

Using FIGS. 6A and 6B, a difference of the output from each edge sensor 24 when the edge sensor 24K is abnormal/has failed and when the conveyed position of the recording sheet 1 laterally is changed, will be described.

Figure 6A:
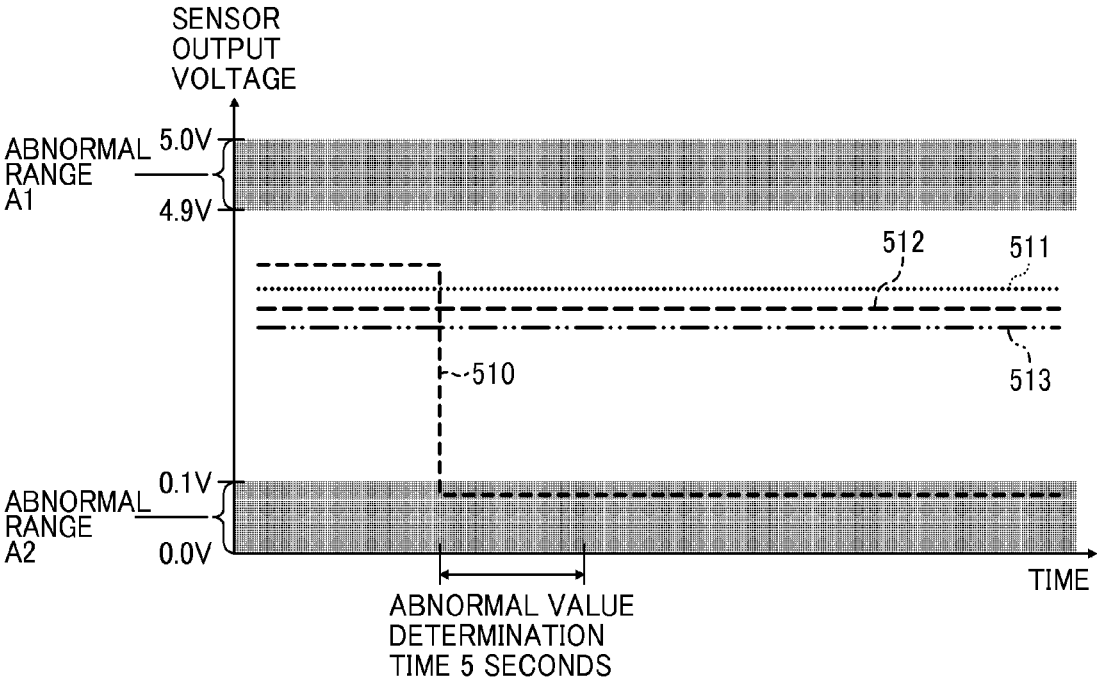
Figure 6B:
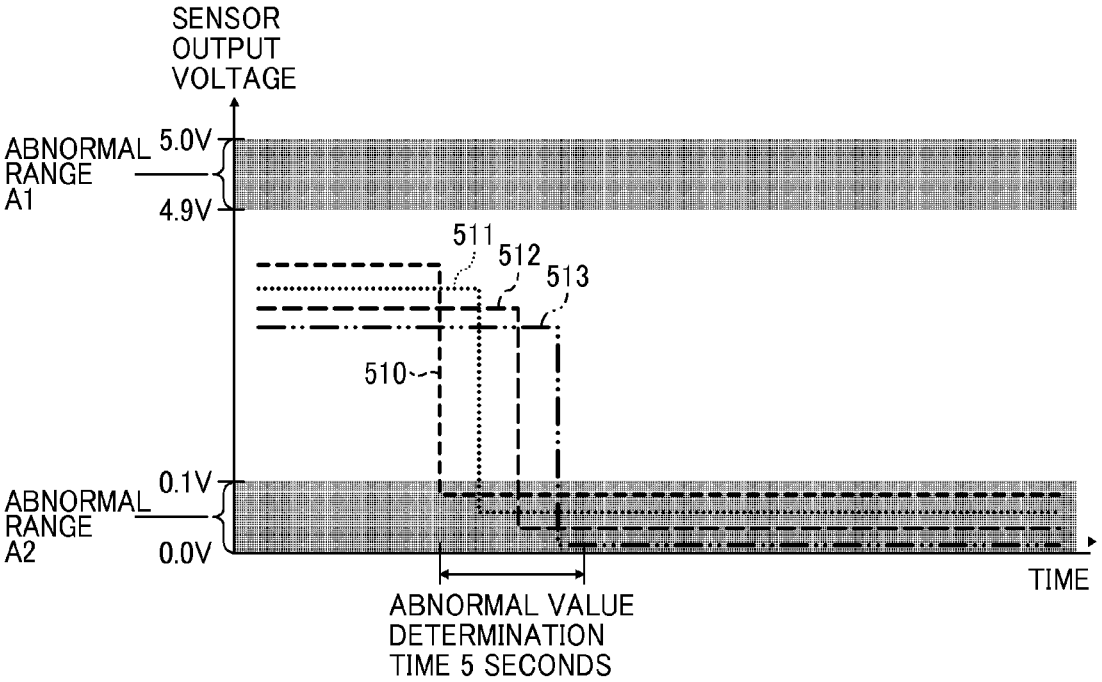

In the graphs of FIGS. 6A and 6B, a vertical axis shows output voltage of the edge sensor 24 and a horizontal axis shows an elapsed time. The output voltage of 4.9V to 5.0V from the edge sensor 24 is set as an abnormal range A1 and the output voltage of 0.0V to 0.1V an abnormal range A2. Specifically, an upper limit abnormal range and a lower limit abnormal range, that is, two abnormal ranges are set with a normal range in between, in the sensor output range.

The abnormal range can be set arbitrarily. The controller 26 serving as a failure determination means determines whether or not the sensor output is within the abnormal range based on the conveyance time period of the recording sheet 1 from the edge sensor 24K farthest upstream in the conveyance direction of the recording sheet 1 to the edge sensor 24Y farthest downstream.

The above conveyance time period as an abnormal value determination time period changes depending on the conveyance speed of the recording sheet 1, and is five seconds when the conveyance speed is fifty meters per minute (50 m/s). It is to be noted that the abnormal value determination time period can be set arbitrarily.

As illustrated in FIG. 6A, during the conveyance of the recording sheet 1, when an output 510 of the edge sensor 24K enters the abnormal range A2 of 0.0V to 0.1V, if the edge sensor 24K alone continues to be in the abnormal range of 0.0V to 0.1V after five seconds, the controller 26 determines that the edge sensor 24K is abnormal/has failed.

As illustrated in FIG. 6B, when an output 510 of the edge sensor 24K enters the abnormal range A2 of 0.0V to 0.1V, if the output 510 of the edge sensor 24K, an output 511 of the edge sensor 24C, an output 512 of the edge sensor 24M, and an output 513 of the edge sensor 24Y are all within the abnormal range of 0.0V to 0.1V after five seconds, the controller 26 determines that the conveyance position changes due to wobbling of the recording sheet 1.

However, the change of the conveyance position of the recording sheet 1 is obtained by outputs of the abnormal value from the edge sensors 24 sequentially from the edge sensor 24K.

Accordingly, after the conveyance distance of the recording sheet 1 is monitored and the edge sensor 24K outputs an abnormal value, the time period of the conveyance distance from the position of the edge sensor 24K to the position of the edge sensor 24Y is defined as the abnormal value determination time period.

As described above, the controller 26 simultaneously recognizes outputs from each edge sensor 24, and determines the failure of the edge sensor 24 based on the relation between outputs from each edge sensor 24. Specifically, the controller 26 determines the failure based on a determination result whether or not each output from each edge sensor 24 is within the abnormal range.

FIG. 7 is a table explaining combinations of outputs of the edge sensors 24 for each color.

If all the outputs from the K sensor, C sensor, M sensor, and Y sensor are within the normal range of from 0.1V to 4.9V, which corresponds to Combination #1, the determination result is normal.

If the outputs of all sensors are within the abnormal range A1 of from 4.9V to 5.0V, which corresponds to Combination #2, the determination result is that the conveyance position of the recording sheet 1 has changed, or that there is no sheet.

If the outputs of all sensors are within the abnormal range A2 of from 0.0V to 0.1V, which corresponds to Combination #3, the determination result is that the conveyance position of the recording sheet 1 has changed.

When the output of one sensor alone is within the abnormal range, any of the combinations 4 to 11 is determined. When a combination other than the above occurs, it is determined that such a case is classified in Combination #12 and all sensors are abnormal.

The combination patterns as illustrated in FIG. 7 are stored in a memory 27 of the controller 26 as a control table, and the controller 26 determines which combination pattern the outputs from each of the edge sensors 24 correspond to, and selects a corresponding determination result.

When it is determined that the sensor is abnormal/has failed, the controller 26 suspends operation of the inkjet recording apparatus 14 and displays a message prompting a user to replace the failed sensor.

Figures 8, 8A:
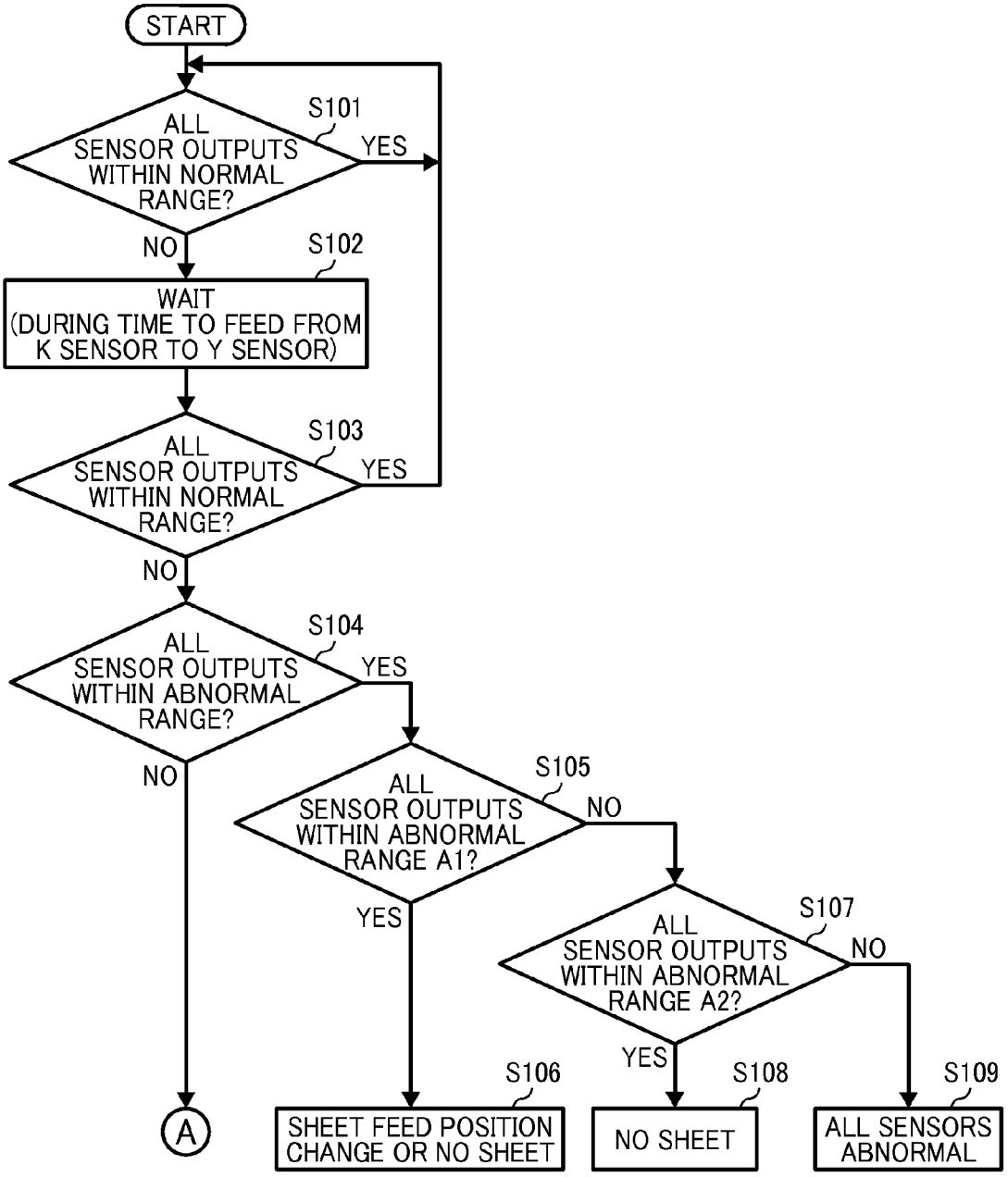
FIGS. 8A and 8B (correctively referred to as FIG. 8) are a flowchart illustrating how the controller determines that a sensor is abnormal/has failed.
Figure 8B:
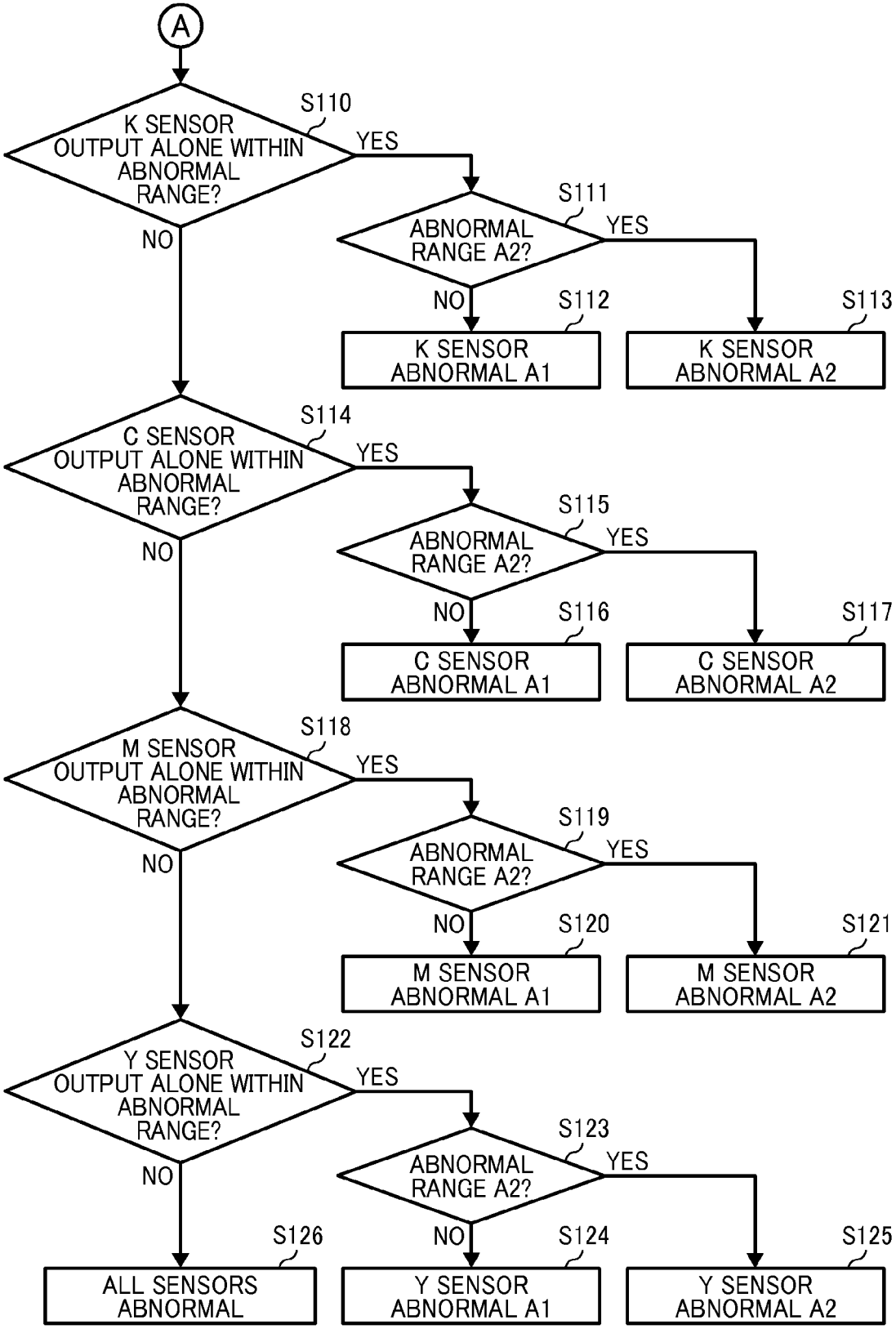

FIGS. 8A and 8B are a flowchart illustrating how the controller 26 determines that a sensor is abnormal/has failed. Such a flowchart is previously generated and is stored in the memory 27.

First, whether or not all the sensor outputs are within the normal range is determined (in step S101). When the output from any sensor is within the abnormal range, the controller 26 waits during a time period to feed the sheet by a distance from the position of K sensor to the position of Y sensor (S102) to prevent a detection error due to a damaged sheet.

Thereafter, whether or not all the sensor outputs are within the normal range is again determined (S103), and it is determined whether or not all the sensor outputs are within the abnormal range (S104) when any sensor output is within the abnormal range.

If all sensor outputs are within the abnormal range and the abnormal range corresponds to A1, the determination result is that the conveyance position of the recording sheet 1 has changed, or that there is no sheet (S105, S106).

If the abnormal range corresponds to A2, the determination result is that there is no sheet (S107, S108). If the abnormal ranges include A1 and A2 in combination, it is determined that all the sensors are abnormal (S109).

If any of the sensor output is within abnormal range, it is determined whether or not the sensor is abnormal/has failed from sequentially K-sensor. If K-sensor output alone is within the abnormal range which corresponds to A1, it is determined that the K-sensor is abnormal A1. If the abnormal range corresponds to A2, it is determined that the K-sensor is abnormal A2 (S111 to S113).

Similarly to the case of the K-sensor, the C-sensor, M-sensor, and Y-sensor are determined (S114 to S125).

If not all but some sensor outputs are within abnormal range, it is determined that all sensors are abnormal (S126).

FIG. 9 is a table explaining combinations of outputs of the edge sensors 24 for each color to identify the sensor abnormality/failure after it is determined that all sensors are abnormal based on Combination #12 in the determination table of FIG. 7 or the step S126 in FIG. 8.

When the output of one sensor alone is within the abnormal range, either of the combinations 13 to 28 is determined.

When a combination other than the above occurs, it is determined that such a case is classified as Combination #12 meaning that all sensors are abnormal similarly to the determination table of FIG. 7.

Figure 10:
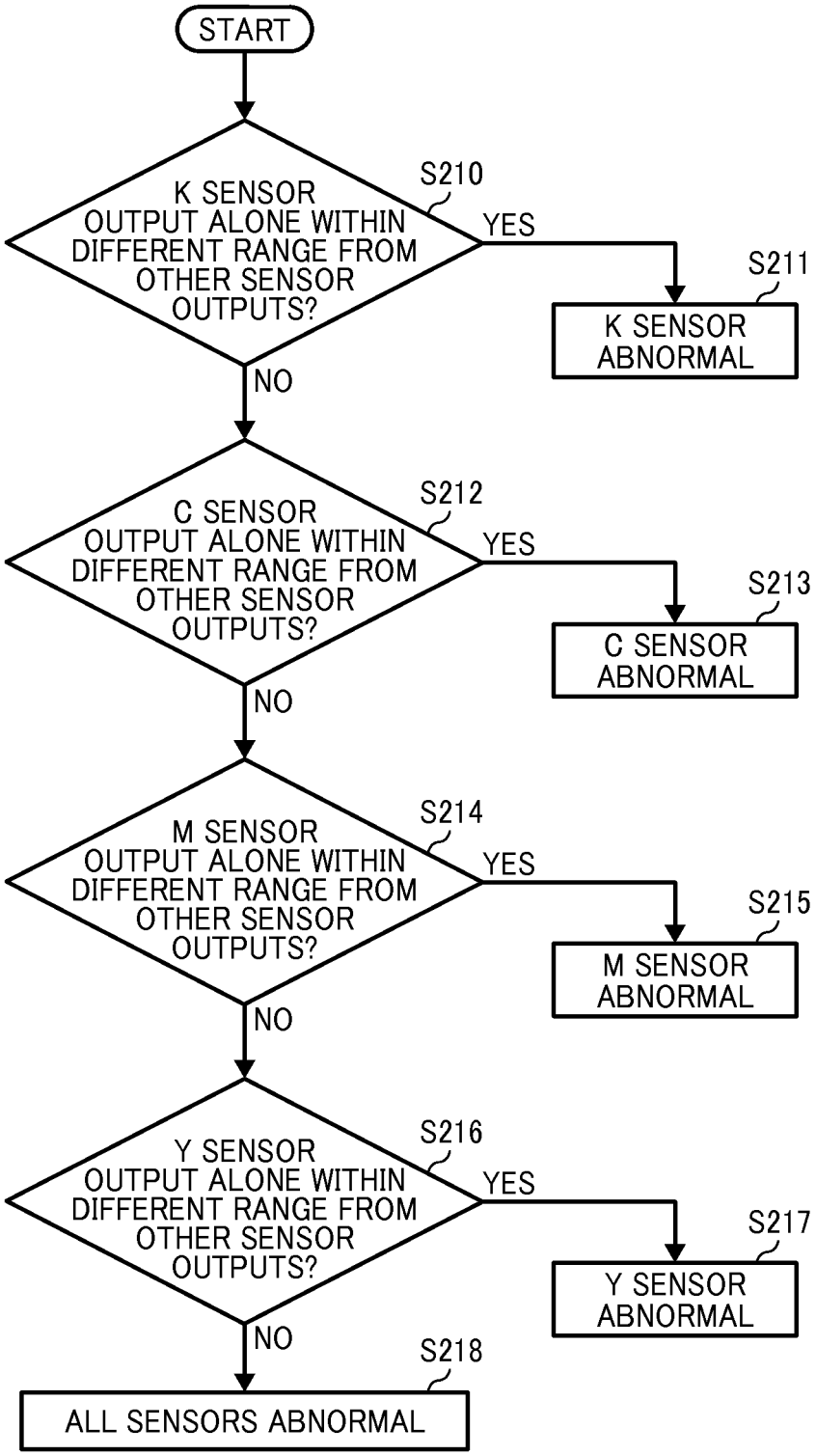
FIG. 10 is a flowchart illustrating how the controller identifies the sensor abnormality/failure after it is determined that all sensors are abnormal.

FIG. 10 is a flowchart illustrating how the controller 26 identifies the sensor abnormality/failure after it is determined that all sensors are abnormal based on FIGS. 7 and 8. Such a flowchart is previously generated and is stored in the memory 27.

When it is determined that all sensors are abnormal based on FIGS. 7 and 8, whether or not the sensor output is within a different range other than other sensor outputs is determined (in step S210 to S217).

When the plural sensor outputs are within a different range, it is determined that all sensors are abnormal as well (S218).

In the present embodiment, the controller 26 serves also as a failure determination means; but the failure determination means may be disposed separately.

In addition, as an edge sensor, an area laser sensor or the like may be employed.

Preferred embodiments of the present invention have been described heretofore; however, the present invention is not limited to the described embodiments and various modifications are possible within the scope of claims unless explicitly limited in the description.

Effects described in the present embodiments are examples of preferred results obtained by the embodiments of the present invention and are not limited to what has been described herein.

Additional modifications and variations of the present invention are possible in light of the above teachings. It is therefore to be understood that, within the scope of the appended claims, the invention may be practiced other than as specifically described herein.

What is claimed is:

1. An inkjet recording apparatus comprising:

a plurality of line heads positioned along a conveyance direction of a recording sheet, each of the plurality of line heads including a plurality of nozzles, each of the plurality of nozzles configured to discharge ink droplets, the plurality of nozzles positioned in a direction perpendicular to the conveyance direction of the recording sheet;

a plurality of edge sensors, a first edge sensor of the plurality of edge sensors corresponding to a first line head of the plurality of line heads, each of the plurality of edge sensors configured to detect a lateral edge of the recording sheet;

a plurality of actuators, a first actuator of the plurality of actuators corresponding to the first line head of the plurality of line heads, the first actuator of the plurality of actuators configured to move the first line head of the plurality of line heads laterally in a sheet width direction of the recording sheet; and a controller configured to, receive output from each of the plurality of edge sensors, determine movement of each of the plurality of line heads based on the received output from the plurality of edge sensors, and identify a first failure for each of the plurality of edge sensors based on a combination of the received output from each of the plurality of edge sensors.

2. The inkjet recording apparatus of claim 1, wherein, the received output from each of the plurality of edge sensors includes an output range, the output range includes a first abnormal range, and the controller is further configured to, identify a second failure based on whether the received output from each of the plurality of edge sensors are within the first abnormal range.

3. The inkjet recording apparatus of claim 2, wherein the controller is further configured to, determine whether each of the plurality of edge sensors do not correspond to at least one of the first failure and the second failure, and determine whether change in a conveyance position of the recording sheet, based on the received output from each of the plurality of edge sensors, are within the first abnormal range.

4. The inkjet recording apparatus of claim 2, wherein the controller is further configured to, determine a third failure based on the received output from the first edge sensor indicating that the first edge sensor is within the first abnormal range, the third failure indicates that the first edge sensor has failed.

5. The inkjet recording apparatus of claim 2, wherein the controller is further configured to, determine whether the received output from each of the plurality of edge sensors are within the first abnormal range based on a conveyance time period of the recording sheet, the conveyance time period includes a time period for the recording sheet to travel in the conveyance direction from the first edge sensor to a second edge sensor, the first edge sensor is a farthest upstream edge sensor, and the second edge sensor is a farthest downstream edge sensor.

6. The inkjet recording apparatus of claim 2, further comprising:

a memory configured to store a control table, the control table including a plurality of combination patterns and a determination result for each of the plurality of combination patterns, the plurality of combination patterns based on a difference of the determination result as to whether the received output from each of the plurality of edge sensors are within the first abnormal range, wherein the controller is further configured to identify a third failure based on the control table.

7. The inkjet recording apparatus of claim 6, wherein, the memory configured to and store a flowchart in the memory, and the controller is further configured to based on the flowchart whether the received output from each of the plurality of edge sensors are within the first abnormal range.

8. The inkjet recording apparatus of claim 2, wherein controller is further configured to determine that the first edge sensor of the plurality of edge sensors has failed when the received output from the first edge sensor is in a first range and the received output from remaining of the plurality of edge sensors is in a second range, the first range is different from the second range.

9. The inkjet recording apparatus of claim 2, wherein the output range of each of the plurality of edge sensors includes a normal range, the first abnormal range and a second abnormal range, the first abnormal range is set as an upper limit, the upper limit is above the normal range, and the second abnormal range is set as a lower limit, the lower limit is below the normal range.

10. The inkjet recording apparatus of claim 1, wherein each of the plurality of edge sensors is a reflection-type optical sensors.

11. An inkjet recording apparatus comprising:

a plurality of edge sensors, a first edge sensor of the plurality of edge sensors corresponding to a first line head of a plurality of line heads, each of the plurality of edge sensors configured to detect a lateral edge of a recording sheet; and a controller configured to, receive output from each of the plurality of edge sensors, the received output from each of the plurality of edge sensors including an output range, the output range including a first abnormal range, determine movement of each of the plurality of line heads based on the received output from the plurality of edge sensors, identify a first failure for each of the plurality of edge sensors based on a combination of the received output from each of the plurality of edge sensors, identify a second failure based on whether the received output from each of the plurality of edge sensors are within the first abnormal range, determine whether each of the plurality of edge sensors do not correspond to at least one of the first failure and the second failure, and determine whether change in a conveyance position of the recording sheet based on the received output from each of the plurality of edge sensors are within the first abnormal range.

12. The inkjet apparatus of claim 11, further comprising:

a memory configured to generate and store a flowchart in the memory, wherein the controller is configured to determine whether the received output from each of the plurality of edge sensors are within the first abnormal range based on the flowchart.

13. The inkjet apparatus of claim 11, wherein the controller is further configured to determine a third failure based on the received output from the first edge sensor indicating that the first edge sensor is within the first abnormal range, the third failure indicates that the first edge sensor has failed.

14. The inkjet apparatus of claim 11, wherein the output range of each of the plurality of edge sensors includes a normal range, the first abnormal range and a second abnormal range, the first abnormal range is set as an upper limit, the upper limit is above the normal range, and the second abnormal range is set as a lower limit, the lower limit is below the normal range.

15. The inkjet apparatus of claim 11, wherein each of the plurality of edge sensors is a reflection-type optical sensor.

16. An inkjet recording apparatus comprising:

a plurality of edge sensors, a first edge sensor of the plurality of edge sensors corresponding to a first line head of a plurality of line heads, each of the plurality of edge sensors configured to detect a lateral edge of a recording sheet; and a controller configured to, receive output from each of the plurality of edge sensors, the received output from each of the plurality of edge sensors including an output range, the output range including a first abnormal range, determine movement of each of the plurality of line heads based on the received output from the plurality of edge sensors, identify a first failure for each of the plurality of edge sensors based on a combination of the received output from each of the plurality of edge sensors, identify a second failure based on whether the received output from each of the plurality of edge sensors are within the first abnormal range, and determine whether the received output from each of the plurality of edge sensors are within the first abnormal range based on a conveyance time period of the recording sheet, the conveyance time period includes a time period for the recording sheet to travel in a conveyance direction from the first edge sensor to a second edge sensor, the first edge sensor is a farthest upstream edge sensor, and the second edge sensor is a farthest downstream edge sensor.

17. The inkjet apparatus of claim 16, further comprising:

a memory configured to store a control table, the control table including a plurality of combination patterns and a determination result for each of the plurality of combination patterns, the plurality of combination patterns based on a difference of the determination result as to whether the received output from each of the plurality of edge sensors are within the first abnormal range, wherein the controller is further configured to identify a third failure based on the control table.

18. The inkjet apparatus of claim 16, wherein the controller is further configured to determine a third failure based on the received output only from the first edge sensor indicating that the first edge sensor is within the first abnormal range, the third failure indicating that the first edge sensor has failed.

19. The inkjet apparatus of claim 16, wherein the output range of each of the plurality of edge sensors includes a normal range, the first abnormal range and a second abnormal range, the first abnormal range is set as an upper limit, the upper limit is above the normal range, and the second abnormal range is set as a lower limit, the lower limit is below the normal range.

20. The inkjet apparatus of claim 16, wherein each of the plurality of edge sensors is a reflection-type optical sensor.

* * * * *